United States Patent [19]

Noding

[11] Patent Number: 4,659,441

[45] Date of Patent: Apr. 21, 1987

[54] PROCESS FOR PREPARING TETRAALKYL 1,1,2,2-ETHENE-TETRACARBOXYLATE

[75] Inventor: Stephen A. Noding, Brusly, La.

[73] Assignee: The Dow Chemical Company, Midland, Mich.

[21] Appl. No.: 840,106

[22] Filed: Mar. 17, 1986

[51] Int. Cl.[4] ..... C25B 3/00

[52] U.S. Cl. ..... 204/59 R; 204/73 A

[58] Field of Search ..... 204/59 R, 73 A

[56] References Cited

U.S. PATENT DOCUMENTS 3,661,739 5/1972 Tomilov et al. ..... 204/73 A 3,871,976 3/1975 Connolly ..... 204/73 A

OTHER PUBLICATIONS

White (II), J. Electrochem. Soc., 124(1977), pp. 1177–1184.

Rifi et al., Introduction to Organic Electrochemistry; M. Dekker; N.Y., N.Y., 1974, pp. 58–61.

*Primary Examiner*—Arthur P. Demers

*Attorney, Agent, or Firm*—E. E. Spielman, Jr.; D. R. Howard

[57] ABSTRACT

This invention relates to a process for the production of a tetraalkyl 1,1,2,2-ethenetetracarboxylate by the electrolysis of a liquid electrolysis medium containing diethyl malonate, an iodide ion electrolyte, and methanol. The electrolysis is run with a current density within the range of about 15 mA/cm$^2$ to about 80 mA/cm$^2$ and at a temperature within the range of about 25° to about 60° C.

9 Claims, No Drawings

PROCESS FOR PREPARING TETRAALKYL 1,1,2,2-ETHENE-TETRACARBOXYLATE

BACKGROUND OF THE INVENTION

This invention relates to an electrolytic process for producing tetraalkyl 1,1,2,2-ethenetetracarboxylates. Such carboxylates can be used as coating for polycarbonates which enhances their clarity and hardness.

It has been disclosed by G. I. Nikishin et al in *Izo. Ahad. Nank. SSSR, Ser. Khim.* 9, 2154 (1984) that tetramethyl 1,1,2,2-ethenetetracarboxylate can be produced electrolytically in an electrolysis medium containing dimethyl malonate, methanol and a sodium iodide electrolyte. The anode and cathode used were, respectively, platinum and iron. A current density of about 220 $mA/cm^2$ was applied through the electrolysis medium and a current efficiency of 60% was reported. However, an attempt by Applicant to duplicate this work produced extensive amounts of degradation products and only a current efficiency of about 10% for tetramethyl 1,1,2,2-ethenetetracarboxylate. The extensive production of the degradation products was believed to be the result of the extremely high current density called for by G. I. Nikishin et al.

The use of lower current densities and a resultant lowering of the production of degradation products is shown in U.S. Pat. No. 4,076,601 wherein it is taught that tetramethyl 1,1,2,2-ethanetetracarboxylate is produced in an electrolysis medium of dimethyl malonate, methanol and an iodide electrolyte. The electrolysis is conducted at a temperature of 50° C. or above. Current efficiencies above 65% for the saturated carboxylate product are reported. However, the current efficiency for tetramethyl 1,1,2,2-ethenetetracarboxylate is shown to be in the range of about 3–5%.

It is therefore an object of this invention to provide an electrolytic process for the production of tetraalkyl 1,1,2,2-ethenecarboxylate with low concomitant production of degradation products and with high current efficiencies for such unsaturated carboxylates.

THE INVENTION

In accordance with the process of this invention, high current efficiencies are obtainable for the production of tetraalkyl 1,1,2,2-ethenetetracarboxylates having the formula:

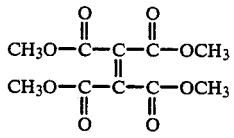

The process is electrolytic and includes subjecting a liquid electrolysis medium containing diethyl malonate, an iodide ion electrolyte and methanol, to an electric current within the range of from about 15 $mA/cm^2$ to about 80 $mA/cm^2$. The foregoing process has exhibited current efficiencies of 75% for the just described, unsaturated carboxylate product.

It is theorized, though the process of this invention is not to be bound by this theory, that the high current efficiency for the unsaturated carboxylate product is a result of a scheme which includes a modified transesterification reaction which occurs during electrolysis. The first step of the scheme is the cathodic formation of the malonate anion as follows:

$$2CH_2(COOC_2H_5)_2+2e^-\rightarrow 2CH^-(COOC_2H_5)_2+H_2 \quad (1)$$

The cathodic conversion of the methanol to the methoxide anion is not, at this time, under the mild electrolytic conditions of the instant process, favored over the malonate anion formation since the pKa's, respectively, of diethyl malonate and methanol are approximately 13 and 16. At the anode, the following is occurring:

$$2I^-\rightarrow I_2+2e^- \quad (2)$$

Then, $$C^-H(COOC_2H_5)_2+I_2\rightarrow ICH(COOC_2H_5)_2+I^- \quad (3)$$

and $$CH^-(COOC_2H_5)_2+ICH(COOC_2H_5)_2\rightarrow(C_2H_5OOC)_2CHCH(COOC_2H_5)_2+I^-$$

occurs. As consumption of the malonate anion continues, and its concentration decreases, the formation of the methoxide anion in accordance with:

$$2CH_3OH+2e^-\rightarrow 2CH_3O^-+H_2 \quad (4)$$

begins and ultimately predominates. The methoxide ion enters into a "transesterification" reaction with the saturated carboxylate as follows:

$$(C_2H_5OOC)_2CHCH(COOC_2H_5)_2+4CH_3O^-\rightarrow(CH_3OOC)_2CHCH(COOCH_3)_2+4C_2H_5O^- \quad (5)$$

Abstraction of a methylene hydrogen then occurs and is favored by the ethoxide ion relative to the methoxide ion and is enhanced by the ethoxide ion's proximity to such hydrogen. This abstraction yields the equation:

$$(CH_3OOC)_2CHCH(COOCH_3)_2+C_2H_5O^-\rightarrow(CH_3OOC)_2CHC^-(COOCH_3)_2+C_2H_5OH \quad (6)$$

In the presence of the iodine formed at the anode, the following occurs:

$$(CH_3OOC)_2CHC^-(COOCH_3)_2+I_2\rightarrow(CH_3OOC)_2CHC(I)(COOCH_3)_2+I^- \quad (7)$$

Once the organoiodide is formed, the ethoxide can react according to:

$$(CH_3OOC)_2CHC(I)(COOCH_3)_2+C_2H_5O^-\rightarrow(CH_3OOC)_2^-CC(I)(COOCH_3)_2+C_2H_5OH \quad (8)$$

Intramolecular elimination of the iodide from the organoiodide anion yields:

$$(CH_3OOC)_2CC(COOCH_3)_2+I^-$$

The process of this invention preferably occurs at ambient (25° C.) temperature, however, it may occur at a temperature within the range of from about 25° C. to about 60° C. In some instances, due to the heat of electrolysis, it may be necessary to provide for cooling of the electrolysis medium to achieve the foregoing temperature range. Such cooling can be accomplished by using a conventional water cooled condenser under a nitrogen purge.

The present process preferably occurs under anhydrous conditions. However, the presence of a small amount of water will not cause significant adverse effects. In general, commercially available anhydrous reaction materials are suitable with no further treatment to remove water being necessary.

The iodide ion electrolyte functions to give high conductivity to the electrolysis medium, of which it is a part, and to directly participate in the electrolytic reaction. The iodide ion electrolyte is not consumed by its participation as it is regenerated in situ for continued use as the reaction proceeds. The iodide ion used must discharge at the anode to yield $I_2$ which in turn reacts with the malonate ester carbanion to yield the iodomalonate ester, as seen in reaction 3. The $I_2$ will also react with the carboxylate anion as shown in reaction 7. Regeneration of $I_2$ occurs when the iodide radical is removed by another malonate anion to yield the saturated tetramethyl 1,1,2,2-ethanecarboxylate, see reaction 3, and when the intermolecular elimination occurs after reaction 8 to yield the unsaturated tetramethyl 1,1,2,2-ethenecarboxylate.

The iodide ion electrolytes can be provided by salts which are soluble in the electrolysis medium and which have cations which do not adversely affect the ongoing reactions of the process. Suitable salts are the alkali metal iodides and the quaternary ammonium iodides. Exemplary of the former are sodium iodide, potassium iodide and lithium iodide. The latter are illustrated by the tetraalkylammonium iodides, such as tetramethylammonium iodide and tetra-n-butylammonium iodide. Of the foregoing, sodium iodide and tetra-n-butylammonium iodide are preferred due to their availability, high solubility and the ease of anodic oxidation of the iodide ion.

The concentration of the salts in the electrolyte medium can vary widely, say, from about 0.1 molar to about 0.5 molar. Generally speaking, economical amounts within the range of from about 0.1 molar to about 0.25 molar are preferably used with good results being obtained.

The diethyl malonate reactant needs to be present in the electrolysis medium in an amount sufficient to provide the saturated tetracarboxylate product of reaction 3. Thus, the concentration of the malonate reactant can vary widely. For reasons of economy and efficiency, the malonate reactant is preferably present in an amount within the range of from about 0.1 molar to about 1 molar.

The methanol reactant acts as both a solvent component of the electrolysis medium and as a supplier of methoxide ions which participate in reactions 4 and 5. The only requirements for the amount of methanol used are that there be a sufficient amount available to dissolve all ingredients of the electrolysis medium but that the amount used not be so large so as to affect the conductivity of the electrolysis medium.

The instant process preferably is operated at ambient pressure and under an inert atmosphere. Super- or subatmospheric pressures can be used but simplicity in equipment design argues well for using ambient pressure. The use of an inert atmosphere, such as that provided by $N_2$, is beneficial as it avoids any deleterious effects of the oxygen present in the ambient atmosphere.

The current density used in the instant process is generally within the range of from about 15 mA/cm$^2$ to about 80 mA/cm$^2$. Current densities within the lower end of this range are not necessarily desirable, though operable, as they do not provide the high yield resulting from use of higher current densities. The use of the high end of the current density range, however, must be considered in view of electrical current resistance, production of degradation products, cooling requirements and the like. A current density within the range of from about 15 mA/cm$^2$ to about 40 mA/cm$^2$ is preferred when all of the above are considered.

The electrolysis is preferably run for a period which maximizes the yield of the unsaturated tetraalkyl 1,1,2,2-ethenecarboxylate before undue loss of the conductivity of the electrolysis medium is realized. The times shown in the Examples are illustrative of useful times for particular systems. Other systems will require optimum times in accordance with their anode surface area, malonate concentration, electrolyte concentration, etc., and such times are best determined empirically.

The electrolytic cell in which the instant process occurs can be any of those types in which a liquid electrolysis medium is used and which are well known to those skilled in the art. In general, the cell will consist of a container and electrodes (anode and cathode) connected to an electric current source. The container can be of a material that acts as the anode or cathode or can be of a material which is resistant to attack under process conditions, e.g., glass, plastic, etc.

The process of this invention is preferably operated with the before mentioned methanol reactant as the highest current efficiencies have been noted therewith. Other alcohols, i.e. propyl and butyl alcohols, however are functional in the instant process, but the current efficiencies may not be attractive from a commercial standpoint.

The anode and cathode used in the present process can be of any electrode material which is relatively inert under process conditions. The anode can be of graphite, or of a precious metal, such as platinum, palladium, ruthenium and rhodium, or be a de-Nova type dimensionally stable anode. It has been found that high density, low porosity graphite electrode material is especially useful as it is highly resistant to degradation and decomposition. Such material is available from Ultra Carbon Corporation of Sherman, Tex. under the trade designation YU6OST.

The cathode can be of stainless steel, carbon steel, a precious metal, such as platinum, and the like, nickel, lead, etc., and when the cell container is the cathode, from a cost and structural standpoint, carbon steel or stainless steel are preferred. When the cathode is not the cell container, then cathodes of iron (carbon steel) and stainless steel are preferred.

Upon completion of the electrolysis, the electrolysis medium is treated to recover the tetraalkyl 1,1,2,2-ethenetetracarboxylate product. One suitable treatment includes filtration of the medium to remove any crystals of the carboxylate product which may have formed and then evaporating the filtrate to about 1/10th of its original volume to effect crystallization of carboxylate product still in the filtrate. The resultant crystals are filtered from the remaining filtrate. These crystals, along with those originally filtered, are washed with methanol and dried.

The following examples illustrate the invention and are not meant to unduly limit same.

EXAMPLES

Equipment

A Hewlett-Packard Model 6269B power supply operating in its constant current mode was used for the electrochemical reaction. The reactions were carried out in a cylindrical carbon steel reactor which was 12 inches (30.5 cm) high with a diameter of 6.25 inches (15.9 cm). A 2 inch (5.08 cm) wide and ¼ inch (0.63 cm) thick carbon steel flange was welded to the top. A sight tube was fabricated on the side of the reactor from two ½ inch (1.27 cm) stainless steel elbow tube fittings which were welded 8 inches (20.32 cm) directly above one another. The top fitting was attached 2 inches (5.08 cm) from the top of the reactor and the second fitting was attached 2 inches (5.08 cm) from the bottom of the reactor. The open end of each elbow faced one another. An appropriate length of clear ½ inch (1.27 cm) diameter FEP Teflon tubing was then connected between each elbow. The reactor functioned as the cathode and a cylindrical block of high density, low surface area graphite with a height of 8 inches (20.32 cm) and a diameter of 4 inches (10.16 cm) functioned as the anode. The low surface area graphite grade YU6OST was obtained from Ultra Carbon Corporation of Sherman, Tex. At the desired current density of about 200 mA/in$^2$ (78.7 mA/cm$^2$), a temperature about 58° C. was generated. Therefore, the apparatus was fitted with a water cooled condenser under a nitrogen blanket. The temperature was monitored via a thermistor. The contents of the reactor were stirred by a mechanical stirrer through a Teflon sleeve and a ¾ inch (1.9 cm) hole in the center of the graphite block. The cathodic electrical connection was achieved by welding a ¼ inch (0.631 cm) threaded bolt to the outside of the carbon steel tube. The anodic electrical connection was completed by first drilling two ¼ inch (0.631 cm) horizontal holes 1 inch (2.54 cm) from the top of the block and 2.25 inches (5.71 cm) between each hole. At the outside of each hole, a recess approximately 1 inch (2.54 cm) square was created by routing a flat surface. A 4×¼ inch (10.2/6.3 cm) all-thread bolt was inserted into each hole. To the end of each of four 4×¼ inch (10.2/6.3 cm) all-thread bolts was silver-soldered a Sta-Kon. The Sta-Kon was fitted around the horizontal graphite inserted bolts and tightly secured against the flat recessed area of the graphite block with a burr. The top of each vertical bolt was then inserted through an appropriate hole which was drilled into a 10.5 inch (26.7 cm) diameter by ½ inch (1.27 cm) thick Teflon plate. The desired level of the graphite block was achieved by adjusting the set-burrs and washers on the underside of the Teflon cover. The anodic electrical connection was completed by fastening the electrical lead to one of the four exposed bolts through the cover. A gasket of porous-Teflon ⅛ inch (0.32 cm) thick was placed around the flange of the reactor. The cover was placed on top of the gasket and secured to the reactor's flange by six equally placed bolts.

GLC analyses of the starting materials and products were carried out with a 6 foot×⅛ inch (183 cm×0.32 cm) stainless steel column packed with 20% SE-30 on Chromosorp W. The oven, injector, and detector temperatures were all set at 200° C. with helium flow rate of 20 ml/min. A Perkin-Elmer Model Sigma 3B machine was used for the GLC analyses.

Procedure

The reactor, described above, was sand-blasted, washed with acetone, fitted with the graphite block which was attached to the cover, and dried with a stream of dry nitrogen which was connected to the top of the water-cooled condenser. After the reactor was dry (approximately 16 hours), the nitrogen fitting on top of the condenser was removed and replaced with a funnel. A dried methanolic solution containing 2730 mls of methanol, 285 mls of diethyl malonate (301 g or 1.88 moles), and 163.4 g of potassium iodide was added to the reactor. This solution was mechanically stirred by a flammable vapor compatible, cone drive, variable speed, Sargent-Welch stirrer Model S-76445. The nitrogen fitting was attached and a slow nitrogen flow was established. The desired rate of stirring was achieved via a Variac. The water to the condenser was turned on and the electrical leads were attached to the appropriate positions on the reactor. A constant current was applied for the desired amount of time. The solution was pale yellow initially until at the very end when the color was a dark red or magenta. As the reaction proceeded, some crystals separated out. After the reaction time elapsed, the reaction was shut down. The solution was filtered. The crystals were washed with methanol, dried, weighed, and analyzed. The filtrate was evaporated to about 1/10th of the original volume and water was added until no more precipitate resulted. The precipitate was collected by filtration, washed with methanol, dried, recrystallized from methanol, washed with methanol, dried, weighed, and analyzed. The melting point of the recrystallized material was 120°–122° C., which compares to a reported melting point for tetramethyl 1,1,2,2-ethenetetracarboxylate of 121° C. The purity according to GLC was approximately 80% tetramethyl 1,1,2,2-ethenetetracarboxylate, 18% tetramethyl 1,1,2,2-ethanetetracarboxylate, and 2% hexamethyl propane-1,1,2,2,3,3-hexacarboxylate. The isolated yield of tetramethyl 1,1,2,2-ethenetetracarboxylate was about 20%.

TABLE I

| Run No. | Malonate | Alcohol | Current Density mA/cm$^2$ | Time | % CE(1) | Percent Yield(2) |
|---|---|---|---|---|---|---|
| 1 | diethyl malonate | methanol | 39.4 | 6 hr. | 75.0 | 20.0 |
| 2 | diethyl malonate | methanol | 59.1 | 8 hr. | 73.0 | 19.5 |

(1)current efficiency for tetramethyl 1,1,2,2-ethenetetracarboxylate
(2)isolated yield for tetramethyl 1,1,2,2-ethenetetracarboxylate
Run No. 1 used a non-porous, high density graphite anode and stainless steel cathode with the anode having 25.8 cm$^2$ of surface.
Run No. 2 used the same material as in Run No. 1 for the anode and cathode except the anode had 322.6 cm$^2$ of surface.

I claim:

1. A process for the electrolytic preparation of tetramethyl 1,1,2,2-ethenecarboxylate from diethyl malonate, which process comprises:

(a) subjecting a liquid electrolysis medium containing diethyl malonate, an iodide ion electrolyte and methanol to an electrical current having a current density within the range of from about 15 mA/cm$^2$ to about 80 mA/cm$^2$; and (b) thereafter recovering the tetramethyl 1,1,2,2-ethenecarboxylate produced in (a) from the remaining liquid electrolysis medium.

2. The process of claim 1 wherein said process occurs at a temperature within the range of from about 25° C. to about 60° C.

3. The process of claim 1 wherein said iodide ion electrolyte is provided by sodium iodide.

4. The process of claim 1 wherein the current density is within the range of from about 15 $mA/cm^2$ to about 40 $mA/cm^2$.

5. The process of claim 1 wherein the iodide ion electrolyte is present in the liquid electrolysis medium at about a 0.1 molar to about a 0.5 molar concentration.

6. The process of claim 1 wherein the iodide ion electrolyte is present in the liquid electrolysis medium at about a 0.1 molar to about a 0.25 molar concentration.

7. The process of claim 1 wherein said diethyl malonate is present in the electrolysis medium at about a 0.1 molar to about a 1 molar concentration.

8. The process of claim 1 wherein said iodide ion electrolyte is provided by potassium iodide.

9. The process of claim 1 wherein said iodide ion electrolyte is provided by an alkyl metal iodide.

* * * * *